US005423255A

United States Patent [19]

Maass

[11] Patent Number: 5,423,255

[45] Date of Patent: Jun. 13, 1995

[54] FEEDING TABLE ASSEMBLY WITH SUCTION BELTS IN SHEET FEEDERS AND METHOD OF ASSEMBLY

[75] Inventor: Burkhard Maass, Heidelberg, Germany

[73] Assignee: Heidelberger Druckmaschinen AG, Munich, Germany

[21] Appl. No.: 173,629

[22] Filed: Dec. 22, 1993

[30] Foreign Application Priority Data

Dec. 22, 1992 [DE] Germany ..... 42 43 486.6

[51] Int. Cl.[6] ..... B41F 13/24

[52] U.S. Cl. ..... 101/232; 271/5; 271/12; 271/34; 271/94; 101/474; 101/479

[58] Field of Search ..... 101/232, 233, 474, 479; 400/635; 271/34, 94, 197, 99, 96, 98, 90, 92, 93, 230, 231, 5, 12, 13, 14, 17, 95

[56] References Cited

U.S. PATENT DOCUMENTS

| | | | |
|---|---|---|---|
| 2,313,100 | 3/1943 | Stevens | 271/94 |
| 3,171,647 | 3/1965 | Bishop | 271/94 |
| 3,648,605 | 3/1972 | Hottendorf | 101/232 |
| 3,861,259 | 1/1975 | Hitch | 271/197 |
| 3,861,669 | 1/1975 | Kubo et al. | 271/94 |
| 4,512,562 | 4/1985 | Moil | 271/12 |
| 4,647,033 | 3/1987 | Emrich | 271/197 |
| 4,651,984 | 3/1987 | Emrich | 271/94 |
| 4,702,471 | 10/1987 | Smith et al. | 271/197 |
| 5,026,038 | 6/1991 | Weller | 271/12 |
| 5,098,982 | 3/1992 | Russel | 271/5 |
| 5,139,253 | 8/1992 | Bohme et al. | 271/94 |
| 5,152,513 | 10/1992 | Ogasawara et al. | 271/5 |
| 5,197,812 | 3/1993 | Worley | 400/635 |
| 5,199,608 | 4/1993 | Seymour et al. | 271/34 |

FOREIGN PATENT DOCUMENTS

| | | | |
|---|---|---|---|
| 0134526 | 3/1985 | European Pat. Off. . | |
| 44-20483 | 9/1969 | Japan | 271/94 |
| 0112742 | 7/1983 | Japan | 271/34 |
| 0171952 | 9/1985 | Japan | 271/197 |
| 0215447 | 9/1987 | Japan | 271/197 |
| 2240771 | 8/1991 | United Kingdom . | |

OTHER PUBLICATIONS

"Vacuum Transport Belting" Xe Disclosure Journal vol. 1 No. 3 Mar. 1976 p. 73.

*Primary Examiner*—Eugene H. Eickholt

*Attorney, Agent, or Firm*—Herbert L. Lerner; Laurence A. Greenberg

[57] ABSTRACT

Feeding table assembly of a sheet-fed printing machine with conveyor belts for conveying paper sheets from a feed pile, via a region for lateral alignment of the sheets, to downline printing units includes a rigid frame; a member having a sheet-conveying surface extending in a conveying direction over the lateral alignment region and formed with at least one through-opening for receiving the rigid frame therein; deflection rollers journaled in the rigid frame; at least one conveyor belt looped about the deflection rollers and having a strand for conveying the paper sheets from a location at a beginning of the sheet-conveying surface to a location beyond the lateral alignment region; a holder fixed to the printing machine; and a device for removably fastening the rigid frame to the holder so that a strand of the conveyor belt provided for conveying is in a conveying position; and method of assembling the conveyor belt with the feeding table.

15 Claims, 12 Drawing Sheets

FEEDING TABLE ASSEMBLY WITH SUCTION BELTS IN SHEET FEEDERS AND METHOD OF ASSEMBLY

The invention relates to a feeding table assembly with suction belts in sheet feeders and method for assembling and securing the suction belts in sheet feeders of printing machines wherein a feeder table of a sheet feeder in a sheet-fed printing machine is provided with conveyor belts for conveying paper sheets from a feed pile, via a region for lateral alignment, to down-line printing units.

It has become known heretofore for suction belts of suction-belt feed tables for sheet feeders of sheet-fed printing machines which convey paper sheets from a feed pile, via a region for lateral alignment, to down-line printing units, to revolve around individually rotatably mounted or supported deflection rollers which are permanently attached or fixed to the machine. Conventionally, the deflection rollers, because of the very great spacing therebetween, dictated both by the length of the conveying path and by the devices located therebetween, are accordingly rotatably mounted in different parts which are fixed to the machine, at least some of the parts, in turn, being used, for example, as mounting bodies for pull lays or for similar external or foreign functional parts. The individual deflection rollers are, respectively, aligned relative to the machine, with the body in which they are supported. An especially precise alignment of the deflection rollers to one another occurs only to a rather limited extent. More particularly, a mounting or support in external functional parts, especially, such as in the body of a pull lay, initially requires a correct alignment of the body relative to the machine if the pull lay is to be operatable. Exact alignment of the various deflection rollers with respect to one another, which is required for belt travel and hence for sheet conveyance or feeding, is necessarily often ignored. However, if it is nevertheless performed conditionally, this involves major expenditure for adjustment of the previously installed individual deflection rollers in the machine. Due to restrictions to mobility in the machine, for example, because of cramped space, alignment is additionally aggravated or rendered more difficult. In conversion or adjustment activities, for example, for securing side lays or external functional parts, or for other maintenance work outside the actual functional range of the belt, adjustments of deflection rollers are readily possible. Thus, in the most varied types of maintenance work, a previous mounting or supporting of deflection rollers, which has been effected to some degree correctly relative to one another, at relatively great expense and effort, would have to be followed in each case by precise checking and, if necessary, a readjustment, which would involve the aforementioned expense and effort. When mountings or supports of the deflection rollers are not precisely adapted to one another, a result thereof is that a conveyor belt extending around them will not lie in the intended conveyance or feed plane and will not move flatly. A departure from the desired feed or conveyance plane, slightly upwardly or downwardly, may partly occur. An exact, uniform location and travel of the conveyor belt and, accordingly, an exact, uniform sheet feeding or conveyance cannot be assured with this heretofore known type of conveyor belt. In the case of suction belts, the result can moreover be that the suction belt leaves the conveyance or feed plane thereof, for example the table top or the top surface of the suction box, and consequently faulty or spurious air is aspirated or sucked between the suction belt and the suction belt guide plane. The spurious or faulty air which emerges laterally of the belt can cause faulty sheet guidance.

In conventional belt conveyor tables of printing-machine feeders, the belts are threaded in by an end thereof, after the deflection rollers have already been mounted or supported in the printing machine, are then threaded through a guide region around the deflection rollers, and then finally glued or welded to the other end of the conveyor belt. For exact and reliable sheet guidance, the welded or glued location must be reprocessed so that it is absolutely flat. Neither bulges nor thickenings or enlargements nor any other disruptions of the belt guidance and hence of the conveyance of the paper sheets is allowed to originate from the connecting location. Particularly when a belt is changed during the printing operation in printing plants, this requires the printing machine operators to expend a great deal of time and perform the most accurate possible handling or processing. For performing the processing or handling, in such belt feed tables, an expensive and complex belt storage device with a large storage space is conventionally provided in the belt travel path, so that the two ends of the belt to be connected can be pulled far enough out of the guide region thereof and can be joined there at the printing machine. This involves a major expense in both space and material.

It has also become known heretofore for sheet braking devices at the feeder, which are provided with a short suction belt extending around a plurality of deflection rollers mounted or supported closely together and a short suction region, to be removed from the operating position thereof together with the deflection rollers. From German Patent 41 26 546, it has become known heretofore to insert such a short suction belt, guided only over a short suction channel between the deflection rollers which are closely or tightly mounted or supported together, immediately up-line from the front lay for slowing down the sheets before the sheets engage the front lay. Because the braking process is brief, use of a short structural form is possible. The problems involved in a long structural form of conveyor belts for conveying or feeding paper sheets from the feed pile via the feed table having the region for lateral alignment do not arise with braking belts which are of short construction.

It is accordingly an object of the invention to provide a feeding table assembly with suction belts and a method of assembling the suction belts with the feeding table in sheet feeders of a sheet-fed printing machine providing a conveyor or feed path for feeding or conveying paper sheets by means of conveyor belts, via the feed table, from a feed pile and, via a region for lateral alignment, to following printing units, the foregoing assembly and method being functionally reliable at little effort and expense.

With the foregoing and other objects in view, there is provided, in accordance with the invention, a feeding table assembly of a sheet-fed processing or printing machine with conveyor belts for conveying paper sheets from a feed pile, via a region for lateral alignment of the sheets, to downline printing units, comprising a rigid frame; means having a sheet-conveying surface extending in a conveying direction over the lateral alignment region and formed with at least one through-opening for receiving the rigid frame therein; deflection rollers journaled in the rigid frame; at least one conveyor belt looped about the deflection rollers and having a strand for conveying the paper sheets from a location at a beginning of the sheet-conveying surface to a location beyond the lateral alignment region; holding means fixed to the printing machine; and means for removably fastening the rigid frame to the holding means so that a strand of the conveyor belt provided for conveying is in a conveying position.

The modular construction enables the preassembly of the deflection rollers in a frame outside the paper-processing or printing machine. Inside the frame and outside the printing machine, the deflection rollers can thus be aligned exactly with one another independently of the printing machine. Outside the machine, the conveyor belt can be stretched over or about the deflection rollers. Then the entire frame with the tightened belt in the working position of the belt is secured in the machine. The frame need merely be secured relative to the machine in a previously adjusted position or after alignment. Maintenance or adjustment work in the machine does not affect the support of the deflection rollers in the frame and hence the location of the deflection rollers relative to one another. Additional adjustment work can be dispensed with. Secure belt guidance and secure sheet guidance are assured. It is also a relatively simple matter to change such a belt even during operation in printing plants. The frame is required merely to be separated from the machine; then the entire module formed of the frame with the deflection rollers supported therein and the belt looped around them is removed from the working position in the machine.

The belt can simply be pulled off the deflection rollers outside the machine. This type of belt conveying table also permits the installation of special belts. For example, in accordance with another feature of the invention, the conveyor belt is a prefabricated elastic belt formed into a closed loop. Such a belt construction facilitates error-free belt assembly. Gluing or welding work by machine operators, such as pressmen, for example, at the location where the belt is assembled on the deflection rollers in printing plants, is unnecessary. The dangers inherent in the joining of the ends of the belt can thus be avoided. The device according to the invention thus permits the use of belts of material which is not joinable at the ends.

In accordance with a further feature of the invention, the belt is formed of continuously knitted fabric. With this construction, especially in the case of suction belts, an arching or bulging of the belt transversely to the belt direction due to notching effects of openings punched into the belt material or otherwise, such as later, formed therein, is able to be avoided.

In accordance with an added feature of the invention, the printing machine has side frames, a driven shaft is journaled in the side frames, and a drive connection from the driven shaft is couplable with one of the deflection rollers. This enables such a conveyor belt to be driven with a drive affixed to the machine.

In accordance with an additional feature of the invention, the feeding table assembly includes means for independently coupling the drive connection with the one deflection roller when the rigid frame has been fastened to the holding means by the fastening means, and means for independently decoupling the drive connection from the deflection roller when the rigid frame is removed from the holding means. This represents a relatively simple construction of the couplable drive connection.

In accordance with yet another feature of the invention, the conveying strand of the conveyor belt is one of an upper and a lower strand thereof; the conveyor belt being formed with a plurality of uniformly distributed through-openings; and including at least one suction box secured in the rigid frame between the upper and the lower strands of the conveyor belt; the suction box being formed with through-openings extending in a direction towards the conveying strand. This provides a relatively easily manipulated and readily changeable construction of a feed table with suction belts. Actually in the case of suction belts, the manner of supporting the individual deflection rollers so that they are aligned exactly relative to one another is especially desirable. Minimizing the positioning tolerances permits reliable guidance of the suction belt on the suction belt guide plane. Faulty or improper air entering between the suction belt at the suction belt guide plane can be avoided reliably.

In accordance with yet a further feature of the invention, the printing machine has a suction-air source affixed thereto; and a suction-air connection couplable with the suction-air source is included. This permits the advantageous modular arrangement of a suction belt with the simultaneous exploitation of the advantages of suction-air sources which are fixed to the machine.

In accordance with yet an added feature of the invention, the suction-air connection comprises a sealing suction-air coupling coupled with the suction-air source when the rigid frame is disposed on the holding means and decoupled from the suction-air source when the rigid frame is removed from the holding means.

In accordance with yet an additional feature of the invention, the suction-air connection has an opening formed in the rigid frame and a corresponding opening formed on the holding means, the openings being disposed in mutually parallel planes and at least approximately parallel to a direction of movement of the rigid frame upon its introduction into a working position thereof.

In accordance with an alternative feature of the invention, the suction-air connection has an opening formed in the rigid frame and a corresponding opening formed on the holding means, the openings being disposed in mutually parallel planes and at least approximately perpendicularly to a direction of movement of the rigid frame upon its introduction into a working position thereof.

In accordance with still another feature of the invention, the suction-air connection is fixed to the rigid frame and extends from the suction box to the inside of the strand other than the conveying strand, and a corresponding suction-air connection fixed to the printing machine and extending to the outside of the strand other than the conveying strand.

In accordance with another aspect of the invention, there is provided a method of assembling and fastening a looped suction conveyor belt with a feeding table of a printing-machine sheet feeder, which comprises, outside of a working position of a suction conveyor belt in the printing machine, initially assembling the suction conveyor belt on a suction-box module having deflection rollers supported therein; then placing the suction-box module, together with the suction belt assembled thereon, into the working position provided therefor in the printing machine; and fastening the suction-box module in the working position. By assembling the entire suction belt outside the printing machine, the advantages noted hereinbefore are attainable.

In accordance with a concomitant mode, the method of the invention which includes assembling the suction conveyor belt comprises stretching a finished closed loop of an elastic suction belt about the deflection rollers of the section-box module. This promotes an assembly-friendly characteristic of the suction belts, particularly when changing suction in printing plants, as described hereinbefore.

The device and method according to the invention, moreover, facilitate the insertion of the most favorable belt for the particular printing job. In the case of conveyor belts, it is conceivable, for example, for the roughness of the conveyor belts to be adapted easily and rapidly to the respective conveying or feeding requirements by changing the belt. In the case of suction belts, furnishing the suction belts with various types of holes can be done quite readily. Thin paper sheets can be transported by suction belts with small holes, while heavy cardboard can be transported by suction belts with large holes. The form of the holes and the number and density thereof can also be adapted individually from one printing job to another. The change can be made simply, quickly and reliably on site in printing plants.

Other features which are considered as characteristic for the invention are set forth in the appended claims.

Although the invention is illustrated and described herein as embodied in a feeding table assembly with suction belts in a sheet feeder and a method of assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 3:
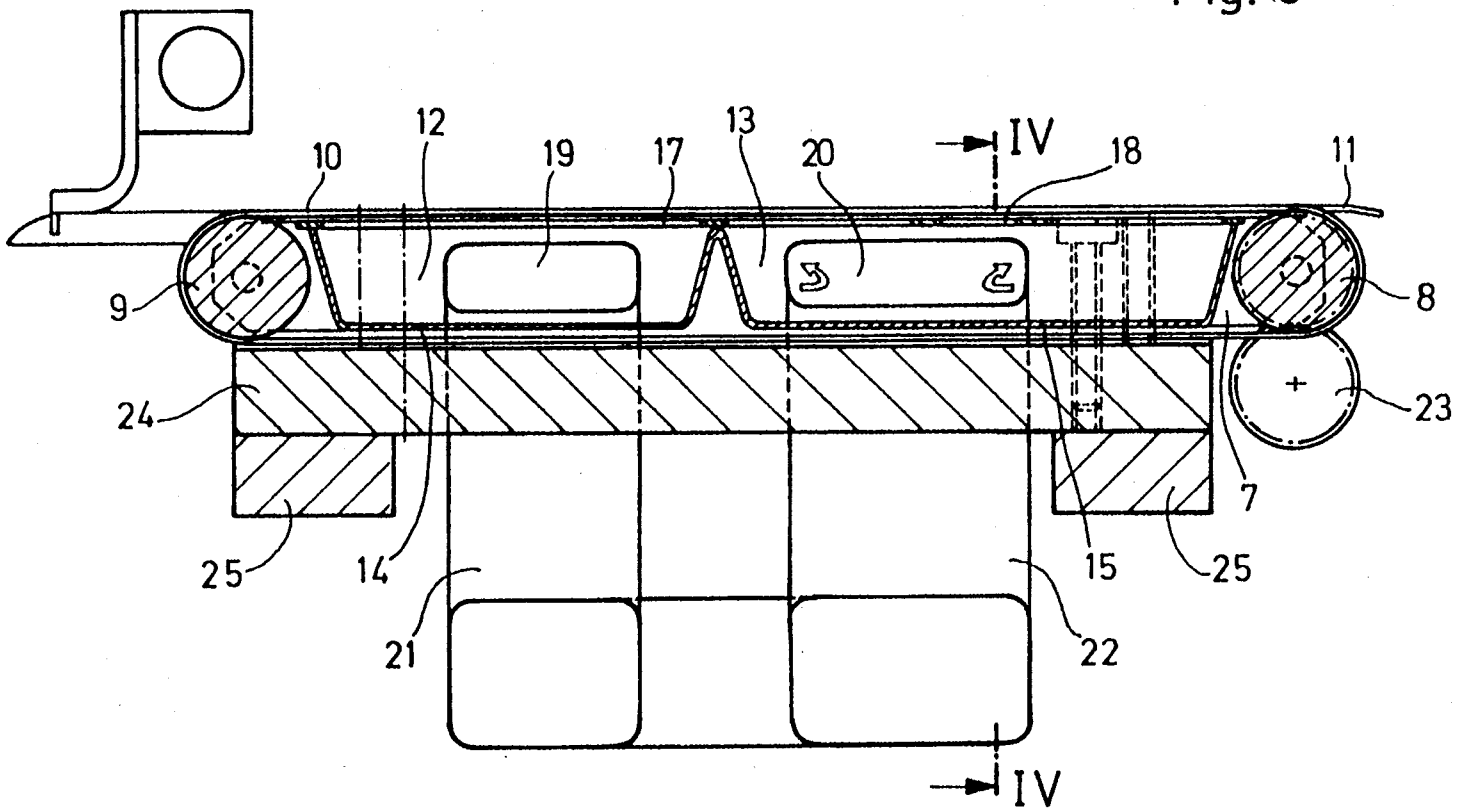
FIG. 3 is a cross-sectional view of FIG. 2 taken along the line III—III in the direction of the arrows.
Figure 6:
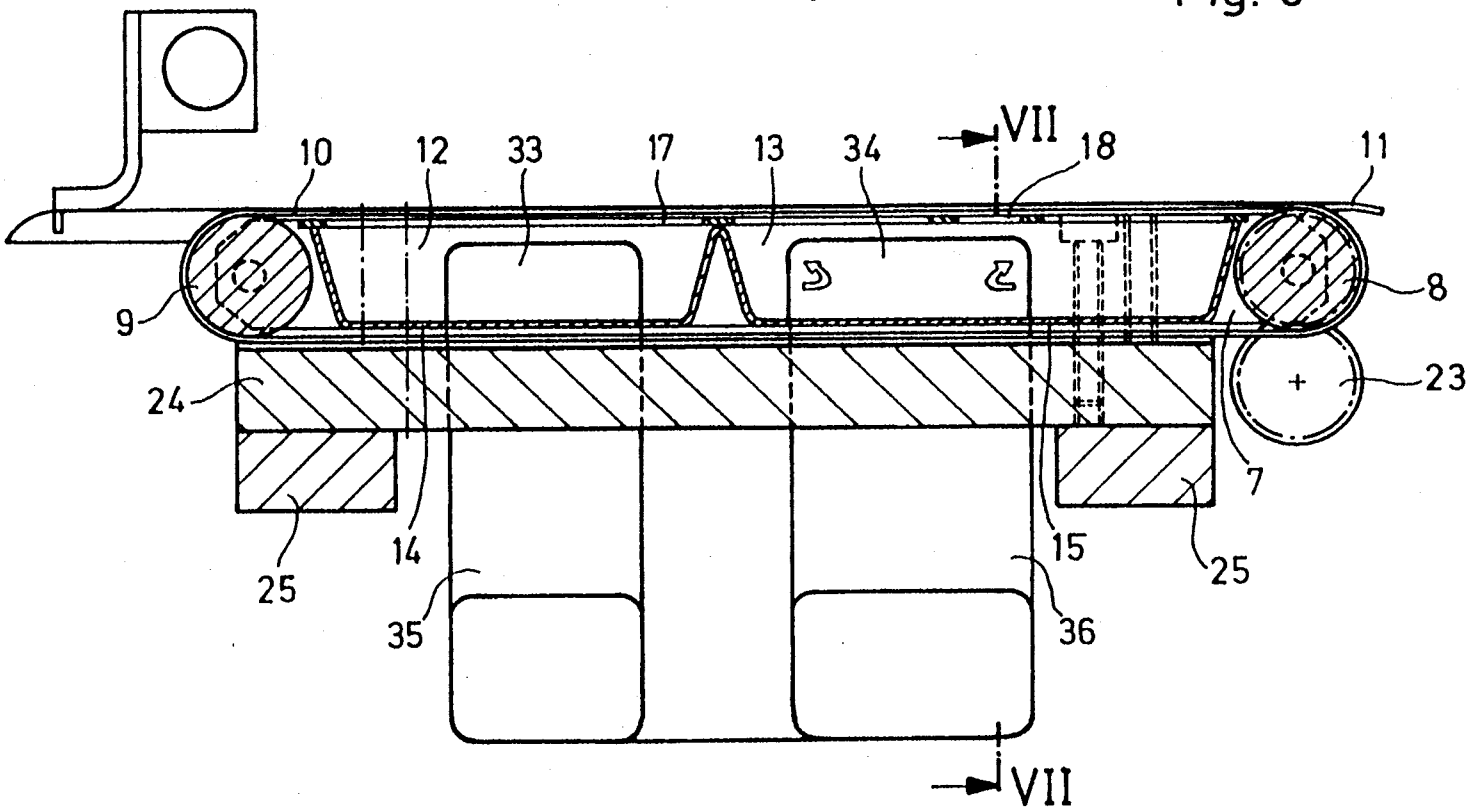
FIG. 6 is a cross-sectional view of FIG. 5 taken along the line VI—VI in the direction of the arrows.
Figure 9:
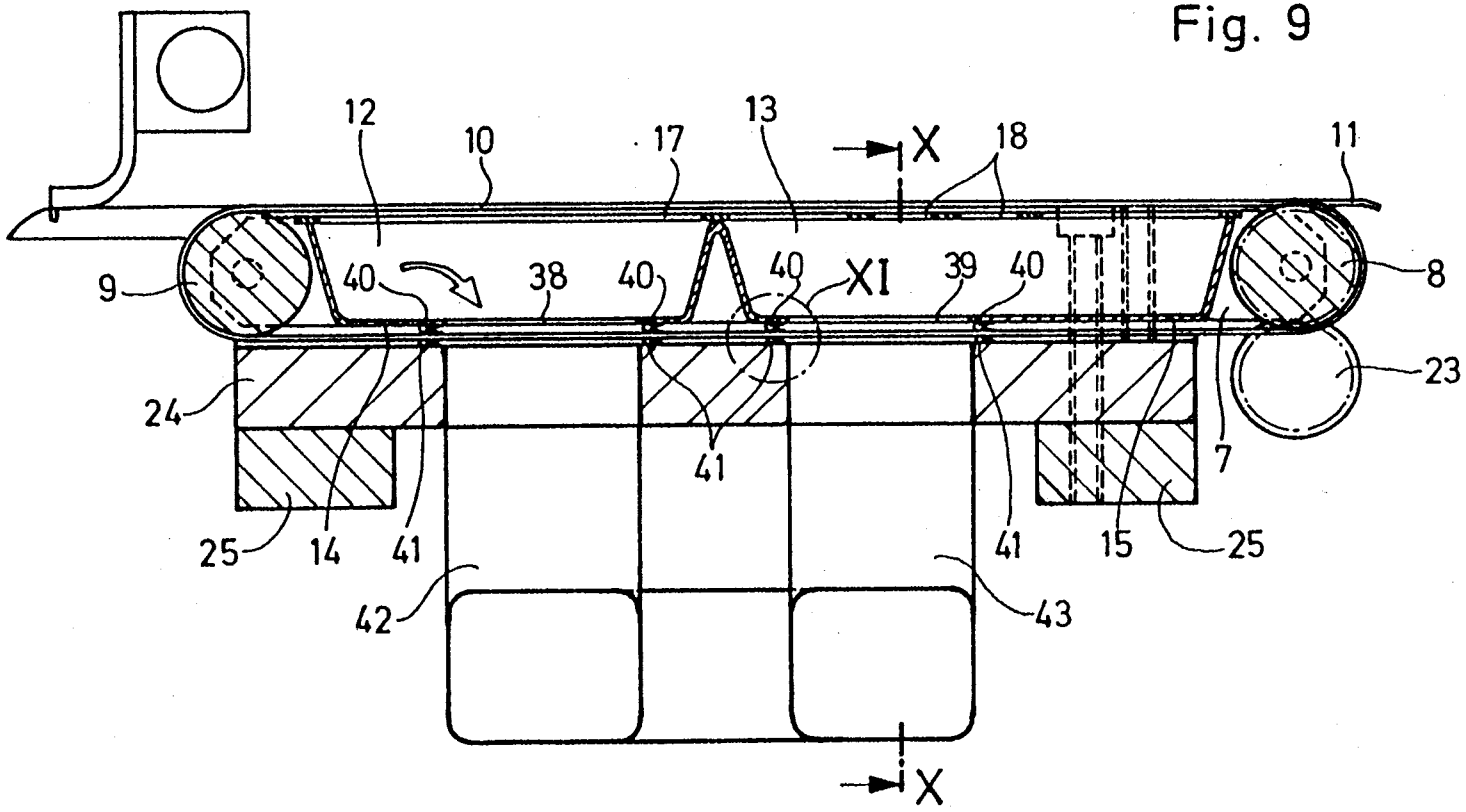
FIG. 9 is a cross-sectional view of FIG. 8 taken along the line IX—IX in the direction of the arrows.
Figure 10:
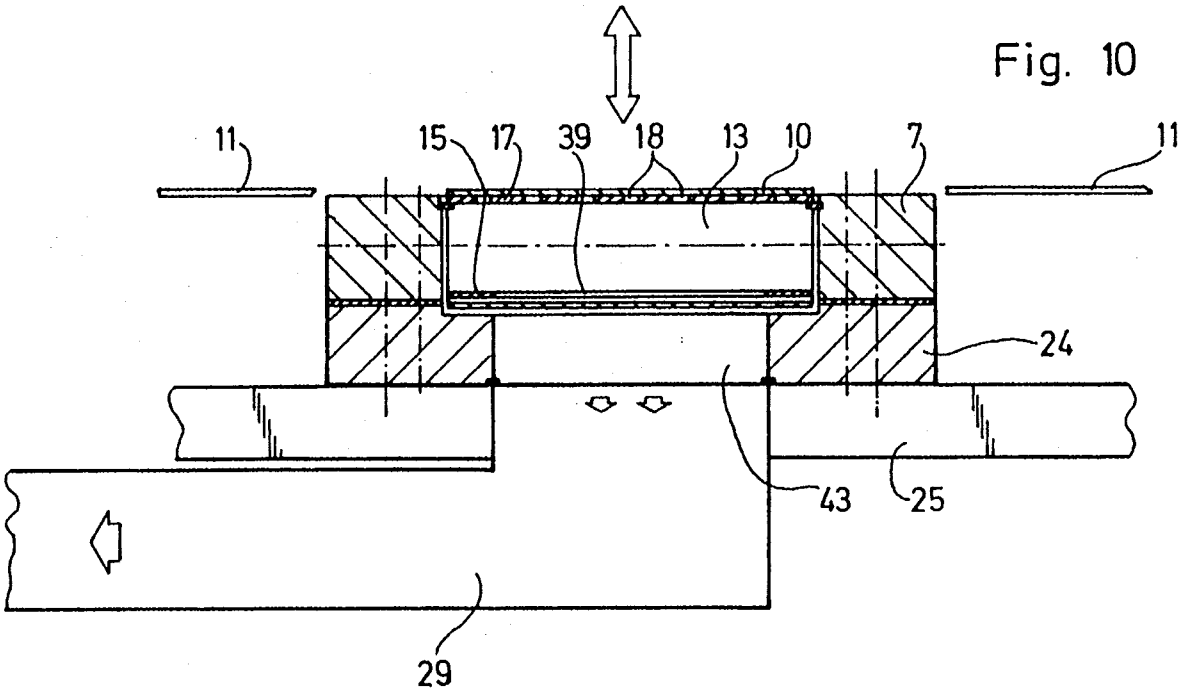
FIG. 10 is a sectional view of FIG. 9 taken along the line X—X in the direction of the arrows.
Figure 12B:
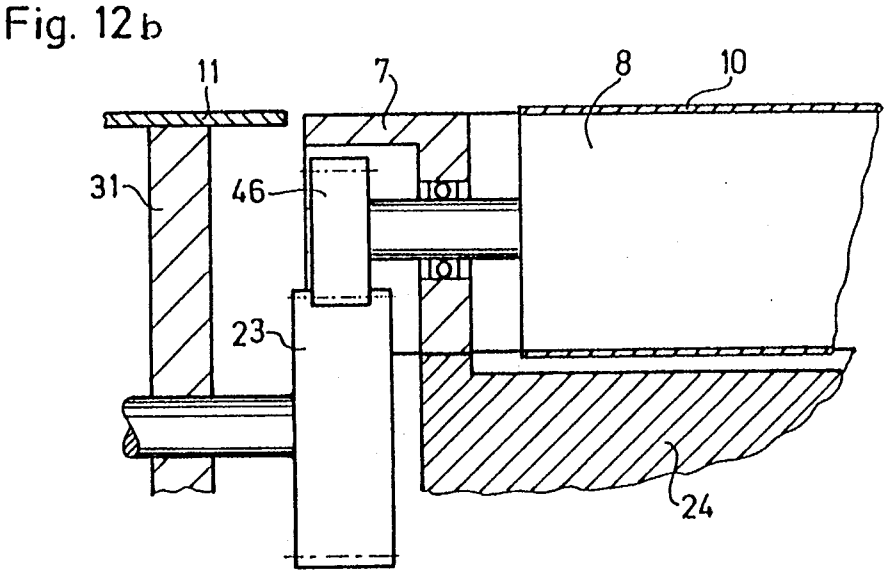
Figure 12A:
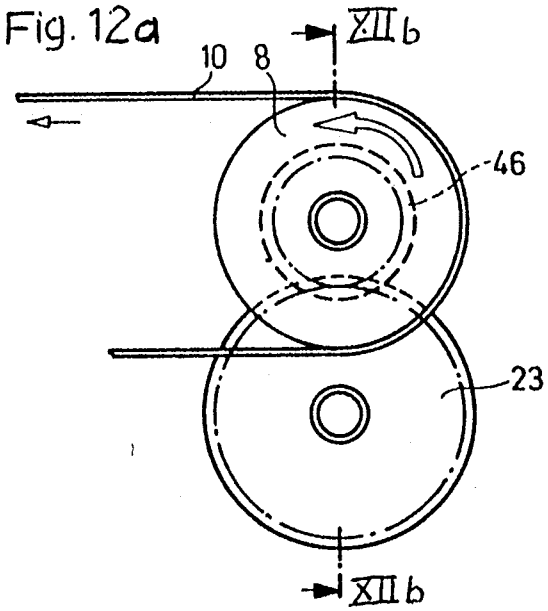
Figure 13B:
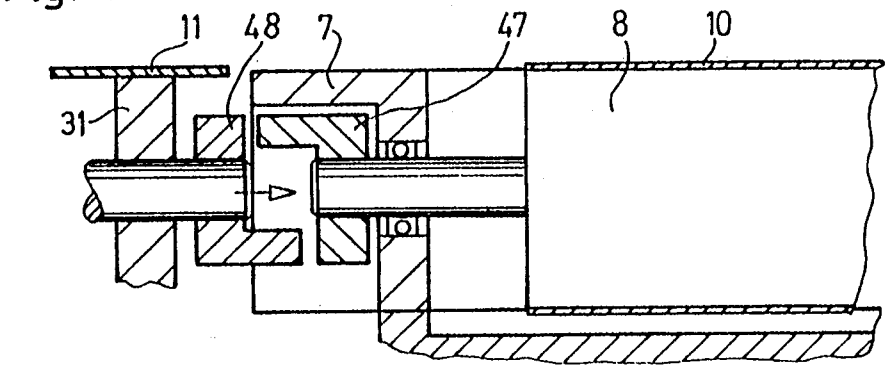
Figure 13A:
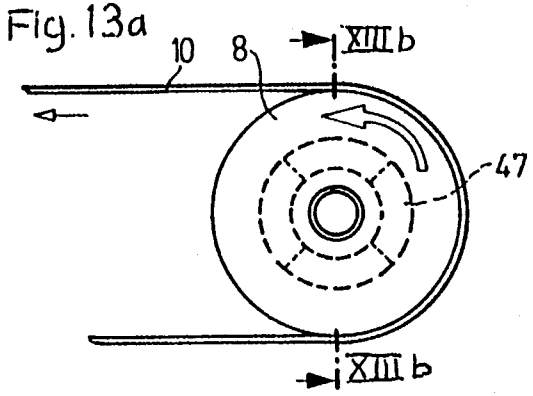
Figure 14A:
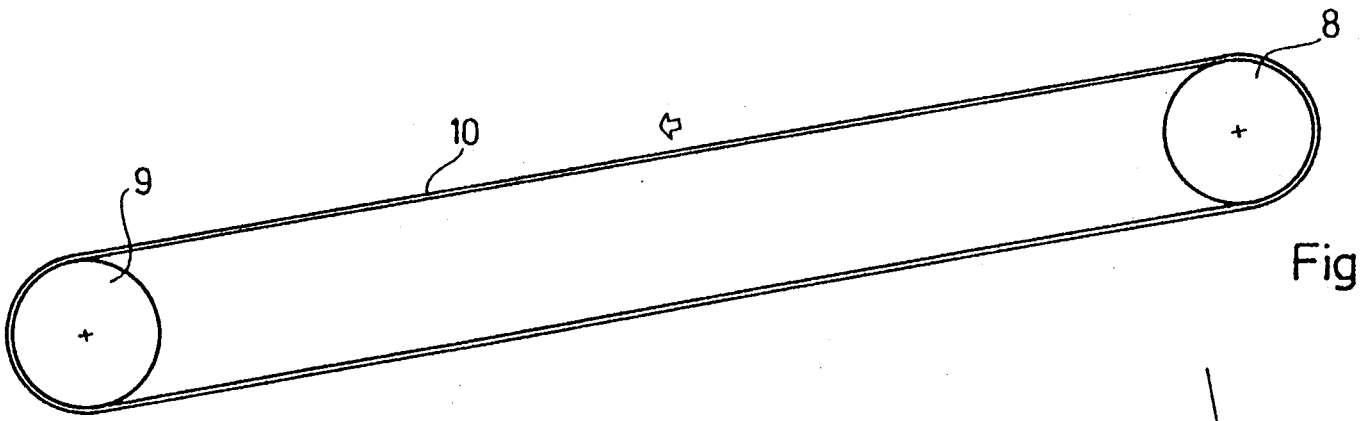
Figure 14B:
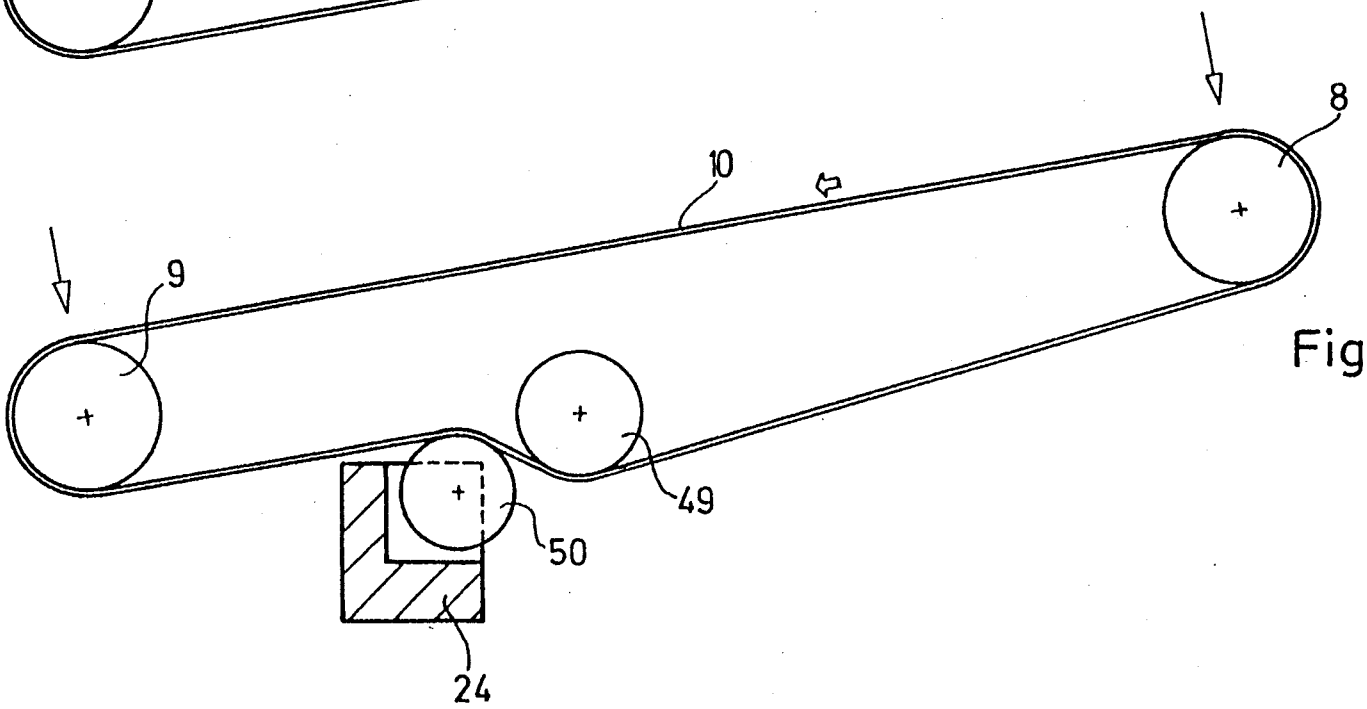

FIG. 12*a* is an enlarged fragmentary view of any of FIGS. 3, 6 or 9, showing a drive connection of the invention;

FIG. 12*b* is a cross-sectional view of FIG. 12*a* taken along the line XIIb—XIIb in the direction of the arrows;

FIG. 13*a* is a view like that of FIG. 12*a* of another embodiment of the drive connection;

FIG. 13*b* is a cross-sectional view of FIG. 13*a* taken along the line XIIIb—XIIIb in the direction of the arrows; and FIGS. 14*a* and 14*b* are diagrammatic side elevational views of different embodiments of installed tautened or tensioned belts.

Figure 1:
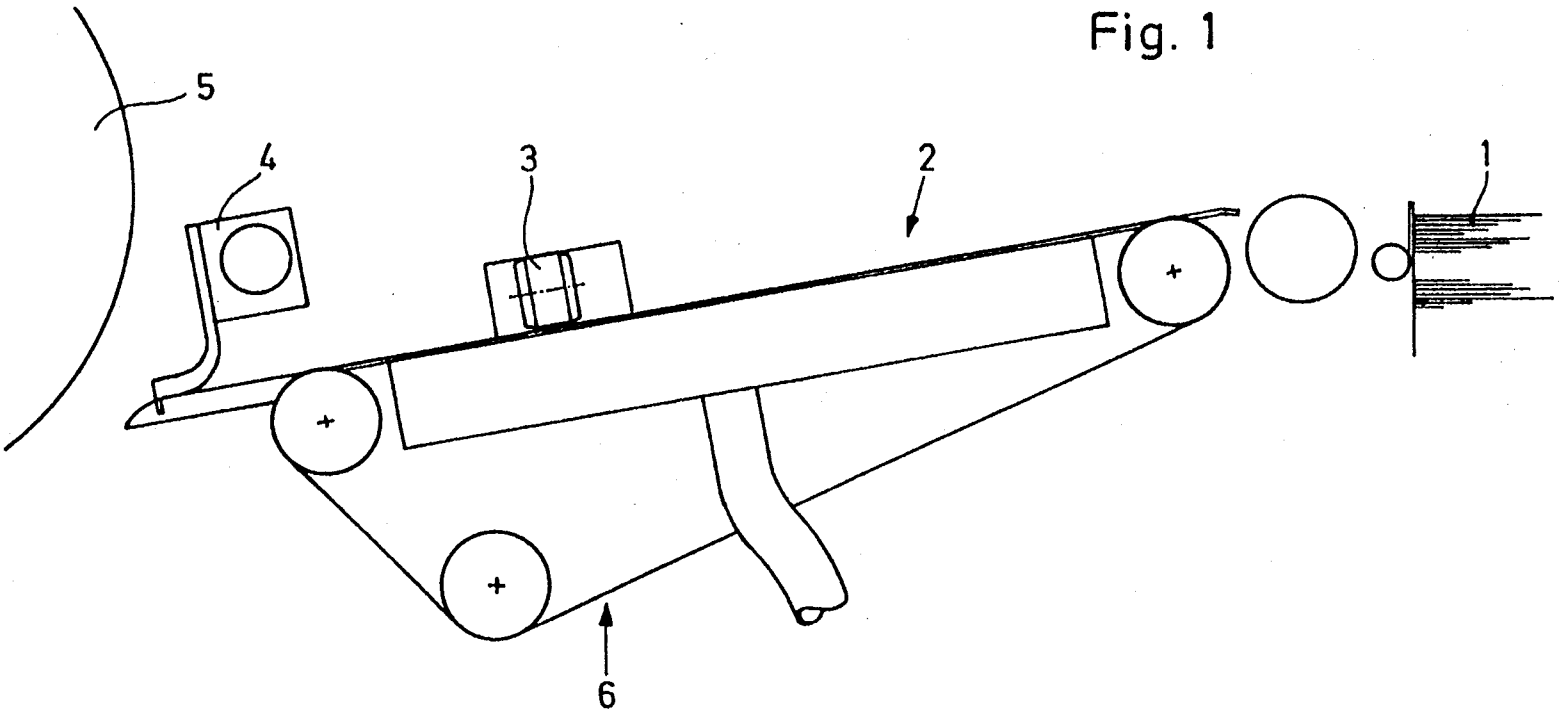
FIG. 1 is a diagrammatic side elevational view of a suction belt conveying device in the feeder of a sheet-fed rotary printing machine.
Figure 2:
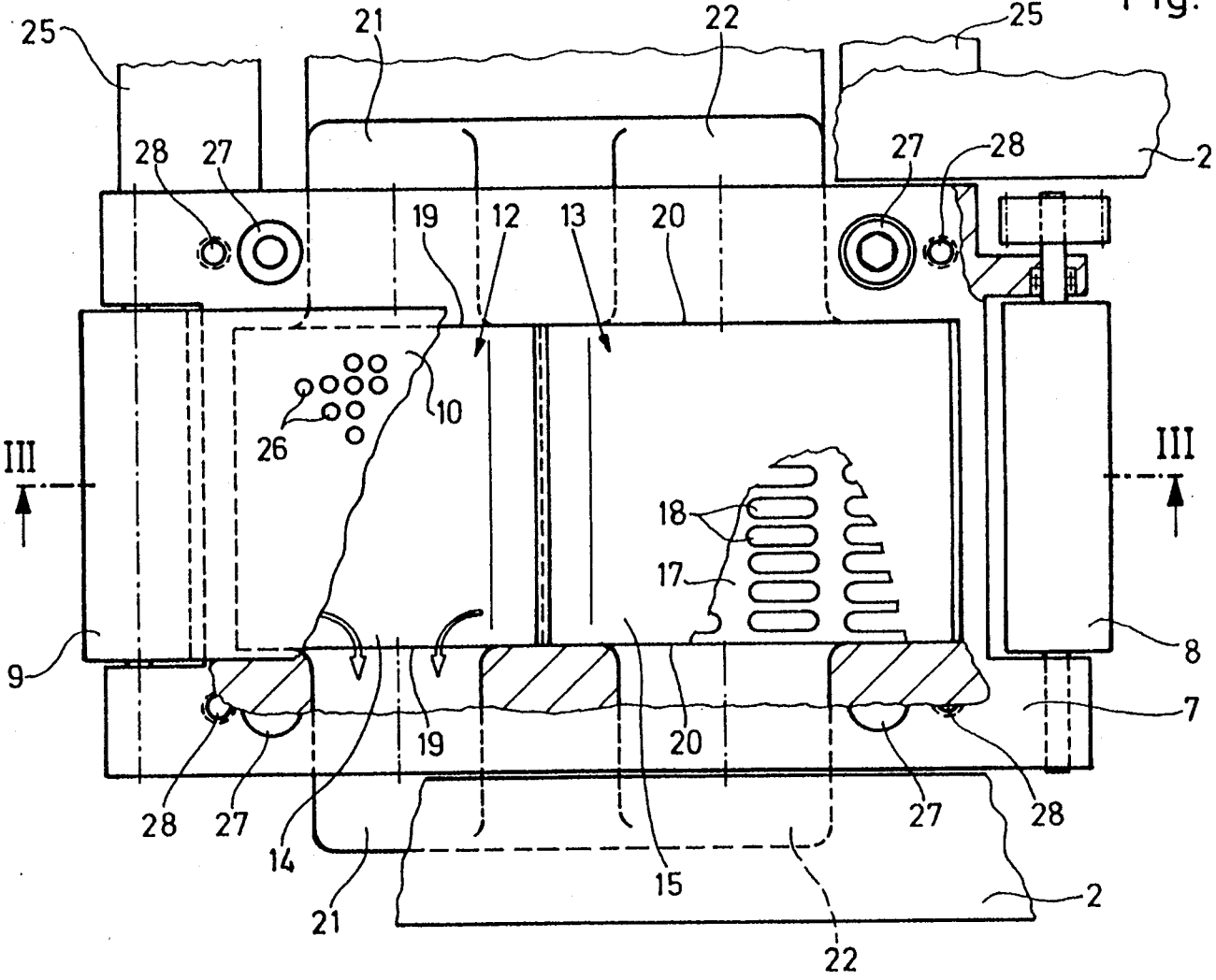
FIG. 2 is a fragmentary top plan view of one embodiment of a suction-belt feeding table assembly according to the invention.
Figure 4:
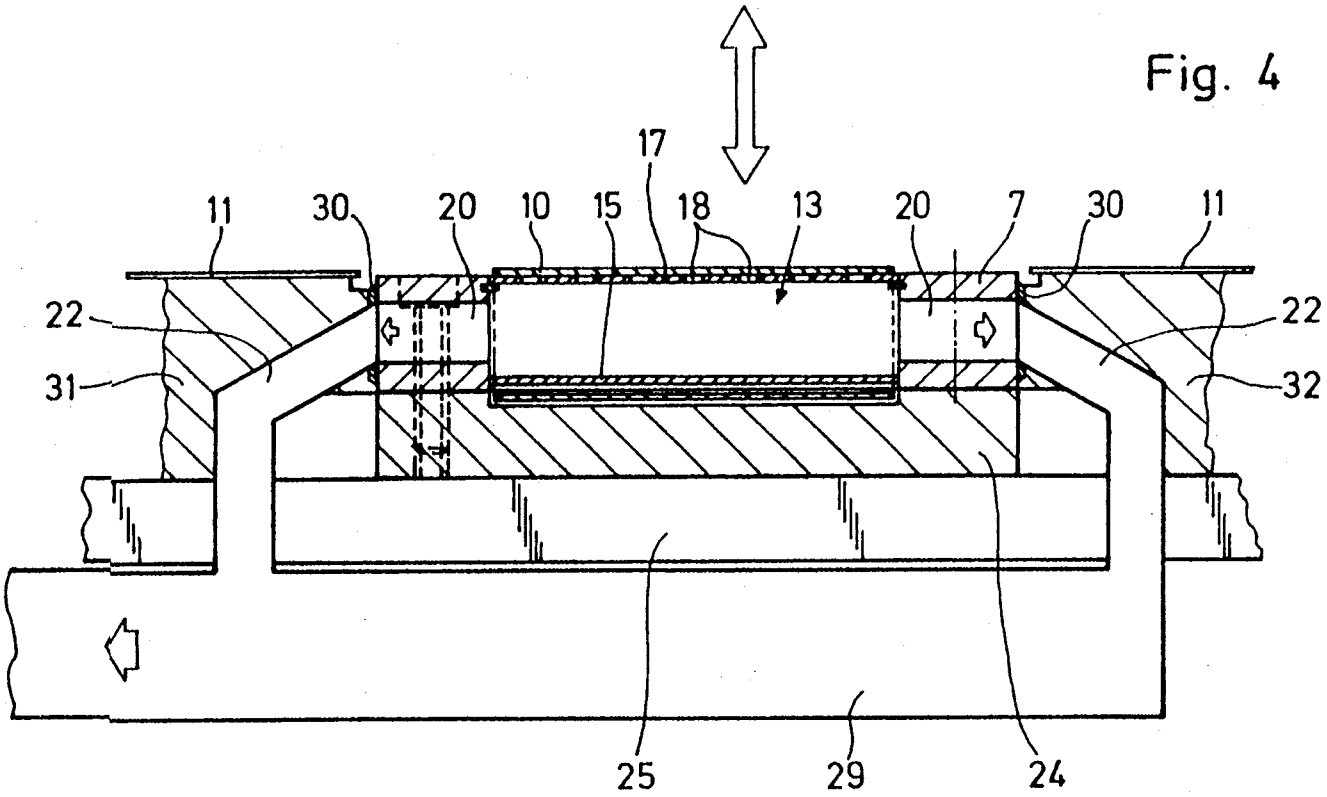
FIG. 4 is a sectional view of FIG. 3 taken along the line IV—IV in the direction of the arrows.

Referring now to the drawings and, first, particularly to FIG. 1 thereof, there is shown therein diagrammatically a feeder table of a sheet-fed offset rotary printing machine, in which sheets of paper are fed in a conventional manner from a feed pile 1 to a feeder table. Provided in the feeder table is a suction-belt conveyor device 6, which holds the sheets of paper against the suction belts in a conventional manner by suction from the underside of the sheets and, by moving the suction belts to side lays 3, at which the paper sheets are aligned along the side edge thereof, conveys them to front lays 4 at which the sheets of paper are aligned along the leading edge thereof. In a non-illustrated conventional manner, the aligned sheets of paper are transferred to following cylinders 5 of a printing unit. FIGS. 2 to 4 illustrate an exemplary embodiment of the type of suction belt conveyor device 6 shown in FIG. 1, wherein deflection rollers 8 and 9 are rotatably mounted parallel to one another in a frame 7. Two suction boxes 12 and 13 are secured in the frame 7. The suction boxes 12 and 13 are formed, respectively, of a box 14, 15 open at the top, the opening being covered by a respective cover plate 16 and 17 secured to the top. Bores 18 are regularly or uniformly distributed in the cover plates 16 and 17. A suction belt 10 in the form of a closed loop extends revolvingly about the deflection rollers 8 and 9 and has an upper strand or run slidingly lying on the cover plates 16 and 17 which have been machined flat or planar. Opening channels 19 and 20, respectively, extend, transversely to the sheet conveying or feeding direction, continuously through to the outside from the respective suction boxes 12 and 13 in the side walls of the frame.

The frame is completely pre-assembled, outside the printing machine, with the suction boxes 12, 13 and deflection rollers 8, 9, and with the suction belt already drawn tight. Thereafter, the frame 7 is secured with the aid of screws 27 to a longitudinal rail 24, extending in the sheet feeding direction and secured below the sheet feeding plane on crossties 25 extending transversely to the sheet feeding direction and secured to the side frame of the machine. When the frame 7 is lowered before being fastened into a niche provided therefor in the feeder table, a sealing attachment connection takes place between the opening channels 19 and 20 extending transversely to the sheet feeding direction in the frame 7, and thereto corresponding suction channels 22 formed in holders 31, 32 for the table tops 11, and extending laterally away from the frame 7. The sealing action is achieved by means of seals 30 surrounding the opening region of the suction channel 22. The suction channels 22 extend below the crossties 25 into a common suction channel 29 to a non-illustrated suction-air source.

A suction-box module, thus formed of the frame 7, the deflection rollers 8 and 9, the suction boxes 12 and 13 and the suction belt 10, already completely preassembled in this manner outside the table or, indeed, outside the printing press, can further in this manner, outside the table region, be made ready exactly for use without being affected by any adjustment processes in the table. The complete suction-box module can be ready for use in the shortest possible time by simply inserting the suction-box module into the niche provided in the table and fastening the frame 7 with the aid of the screws 27. From the non-illustrated suction-air source, the suction boxes 13 and 14 are subjected to negative pressure via the suction channel 29 as well as the suction channels 22 and 21 and the opening channels 19 and 20. Sheets of paper resting on the suction belt can be conveyed exactly due to movement of the suction belt by means of the openings 18 in the cover plates 16 and 17 and by means of the holes 26 in the suction belt. To change the suction belt or to use a different suction box with other openings, depending upon the individually desired suction and conveying or feeding relationship as a function of the particular printing job involved, it is possible, by simple, rapid loosening of the screws 27, to release and remove the frame 7, and hence the complete suction-box module from the position thereof in the table, and to replace it outside the table with a completely new model, for example, with other cover plates 17, or to replace it with a different type of belt. The used suction belt 10 can also be replaced quickly in the same module outside the table, by using relatively simple means.

For removing the module, or for easier insertion of the module into the desired position in the table, detaching threads 28 may be additionally provided in the frame 7. By simply screwing hook screws into the detaching threads 28 before removing the suction module from its working position in the table, the complete suction module thus becomes readily manipulatable. After a suction module has been inserted, the hook screws are unscrewed and removed before sheet conveying or feeding begins.

Figure 5:
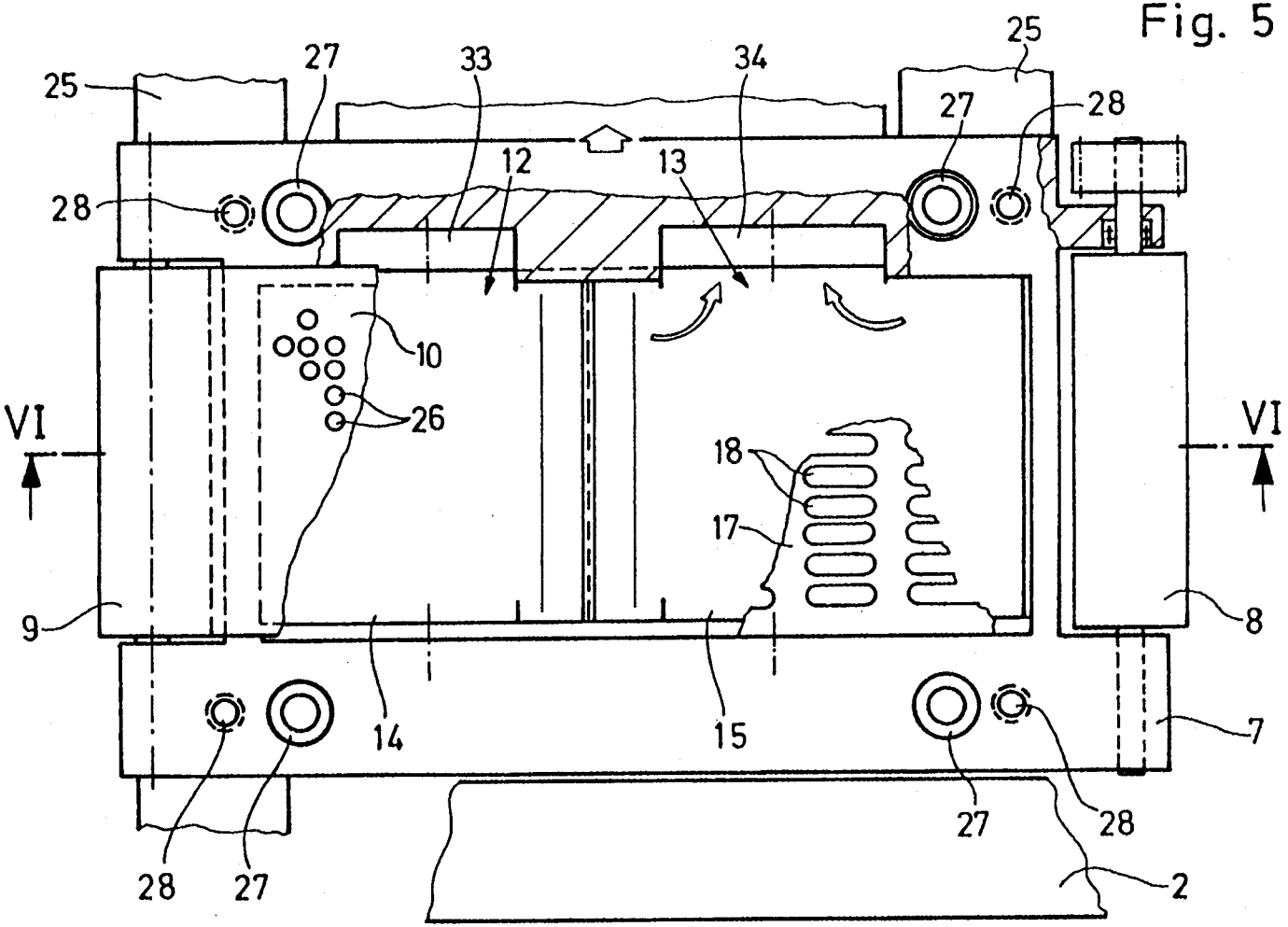
FIG. 5 is a view like that of FIG. 2 of another embodiment of the suction-belt conveying device.
Figure 7:
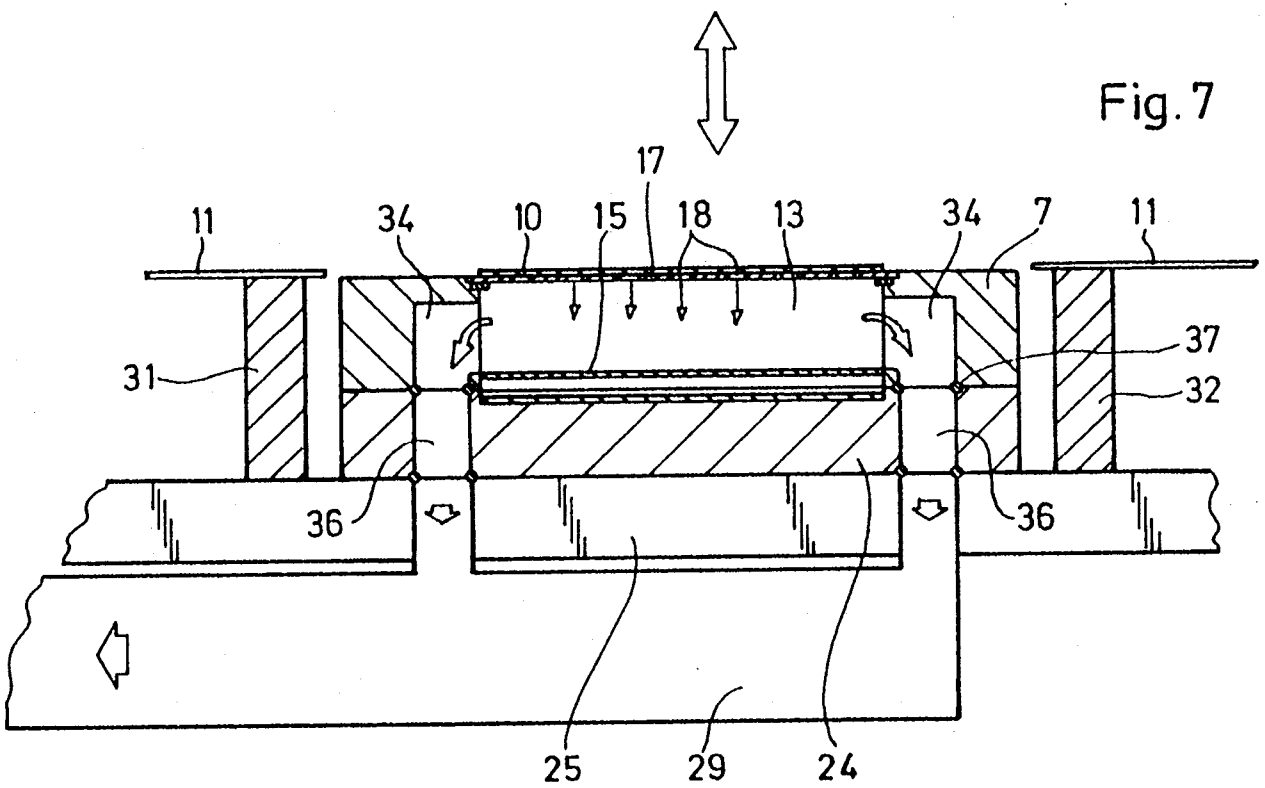
FIG. 7 is a sectional view of FIG. 6 taken along the line VII—VII in the direction of the arrows.
Figure 8:
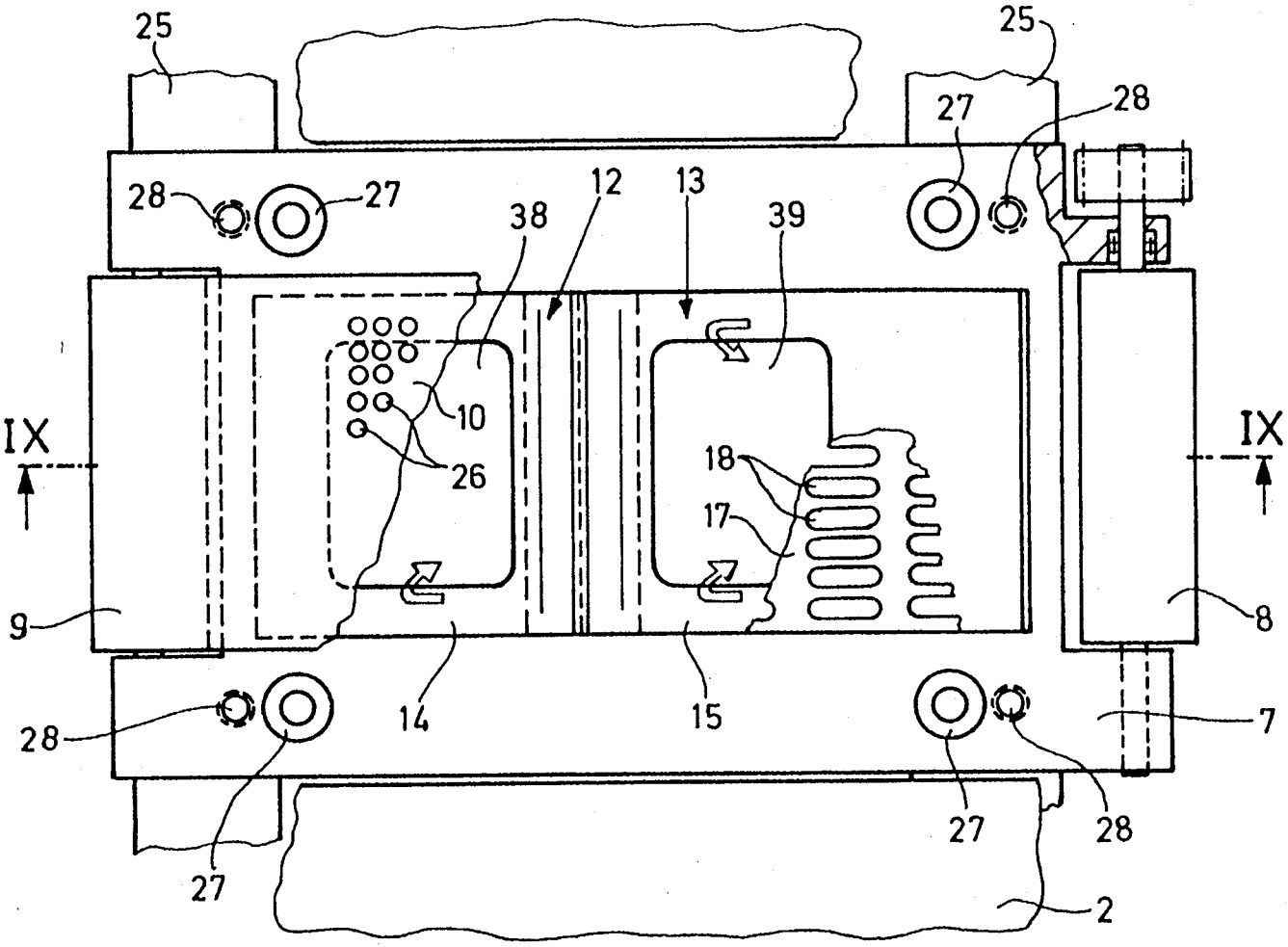
FIG. 8 is a view like that of FIGS. 2 and 5 of a further embodiment of the suction-belt conveying device.

FIGS. 5 to 7 show a further exemplary embodiment of this type of suction belt conveying device. The opening channels 19 and 20 extending laterally out of the suction box are deflected downwardly in the frame 7 from the suction boxes 12 and 13 in the frame 7. When the frame 7 is fastened onto the longitudinal rail 24, the outlet openings of the channels from the frame 7 enter into sealing contact with corresponding, upwardly-directed suction channels 36. These channels, in turn, terminate in a common suction channel 29, as shown in the exemplary embodiment of FIGS. 2 to 4, which, in turn, terminates in a non-illustrated suction source. The corresponding openings of the respective suction channels 34, 36 and 33, 35, i.e., openings extending perpendicularly to the direction in which the frame is introduced, or in other words vertically downwardly onto the longitudinal rail, make it possible, in an especially simple manner, to seal off securely the suction-air connection between the frame 7 and the suction-air source. For this purpose, it is sufficient merely to fasten ordinary sealing disks 37 or O-rings between the suction channel 36 and the opening channel 34, on the one hand, and between the suction channel 35 and the opening channel 33, on the other hand, respectively. The suction-box module is sealingly fastened in this manner in the niche provided in the table by simply tightening the screws 27 on the longitudinal rail 24.

Figure 11:
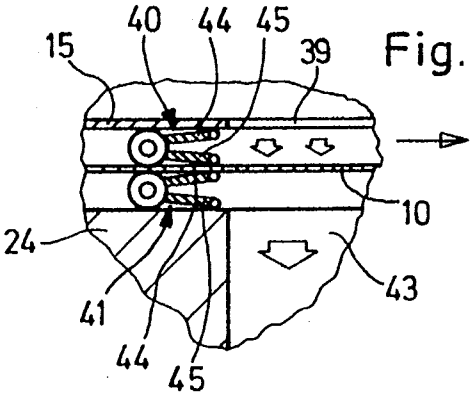
FIG. 11 is an enlarged fragmentary view of FIG. 10 showing a seal thereof.

In the exemplary embodiment of FIGS. 8 to 11, a suction belt conveyor device is shown wherein suction-air feeding is effected from a non-illustrated suction-air source via a suction channel 29 and suction channels 42 and 43 connected thereto and extending from below through the longitudinal rail 24. The suction air travels from the suction channels 42 and 43, via the lower strand or run of the suction belt 10 and respective openings 38 and 39 formed in the bottom of the boxes 14 and 15 of the suction boxes 12 and 13, into the interior of the suction boxes 12 and 13. For sealing purposes, seals 40 and 41 extending transversely to the belt conveying device are provided, as shown in FIGS. 9 and 11. A respective seal 40 is disposed on either side, i.e., as viewed in the belt conveying direction, both upstream and downstream of the opening 38 and upstream and downstream of the opening 39 below the boxes 14 and 15, respectively, above the lower strand or run of the suction belt in the frame 7. On the longitudinal rail 24, a respective seal 41 extending transversely to the belt conveying direction is disposed, likewise as viewed in the belt conveying direction, upstream and downstream of the opening of the respective suction channel 42 and 43. The seals 40 and 41 are provided with two sealing lips 44 and 45 spread apart upwardly and downwardly, respectively, in the shape of a V. The sealing lips are of conventional construction and may be formed of the material known as PTFE or polytetrafluoroethylene, for example. The sealing lips are so arranged that, when the suction-box module is fastened to the longitudinal rail, a sealing action ensues between the suction boxes and the suction belt with the aid of the seals 40, and a sealing action likewise ensues between the suction belt and the longitudinal rail 24. The sealing lips 44 and 45, respectively, are disposed one above the other, and are oriented in the direction of movement of the strand or run of the belt.

As shown in FIGS. 12*a* and 12*b*, for the purpose of driving the suction belt, it is possible to provide the deflection roller 8, which is mounted in the frame 7, with a gear wheel 46 which, when the suction belt module is introduced from above into the niche provided in the feeding table, comes into meshing contact with a gear wheel 23 fastened on a drive shaft connected to the printing-machine drive and supported, for example, in the holder 31 of the table or in the side frames of the printing machine.

It is also conceivable to provide, instead of this gear-wheel connection, a claw coupling as in the embodiment illustrated in FIGS. 13*a* and 13*b*. In this regard, an entrainer or driver claw 47 is fastened to the shaft of the deflection roller 8. When the suction-box module is disposed in the niche provided in the feeder table, the claw 47 becomes operatively connected with a corresponding drive claw 48 of a drive shaft supported in the side frame of the printing machine or in a holder 31 of the table top.

In the aforedescribed exemplary embodiments, it is possible to change a suction belt 10 in a relatively simple manner outside of the feeding table. It is also possible, after an elastic suction belt 10 has been stretched counter to the elastic forces thereof, to lift it from the deflection rollers 8 and 9 and replace it with a new elastic belt, in the same manner. The elastic tension of the belt then produces a holding or retaining tension on the deflection rollers 8 and 9. For assembly and disassembly, the belt is spread apart somewhat counter to the tensioning forces. It is also conceivable, as shown for example in FIG. 14*b*, to journal a deflection roller 49 in the frame 7 so as to reduce the tensional force to be applied by the assembler. A further deflection roller 50 may be journaled or rotatably supported in the longitudinal rail 24. By introducing the suction belt module into the niche provided in the table, both the deflection roller 49 acting upon the suction belt from the inside, and the deflection roller 50 acting upon the suction belt from the outside form a tensioning device, so that the web tension needed for belt conveying is not produced until the suction belt module has been introduced into the position thereof provided in the table niche. The assembly and disassembly, respectively, of the suction belt can be further simplified by such a device. In the described suction belt modules, it is also possible for a suction belt joinable or connectible at the ends thereof to be guided or extended simply about the deflection rollers in a conventional manner, outside the feeder table, however, and cemented or glued together or welded together at the ends thereof, and then for the abutting locations to be joined and refinished wherever the work may be performed best within a printing plant. It is also conceivable, however, with such a device, to directly install suction belts which have already been joined and refinished into a closed loop previously. Moreover, it is conceivable to use suction belts which are already finished or manufactured in the form of a closed loop. It is especially conceivable, for example, to install belts which have been knitted or woven in a closed loop in the feeder region of a sheet-fed offset rotary printing machine.

I claim:

1. Feeding table assembly of a sheet-fed printing machine with conveyor belts for conveying paper sheets from a feed pile, via a region for lateral alignment of the sheets, to downline printing units, comprising a rigid frame; means having a sheet-conveying surface extending in a conveying direction over the lateral alignment region and formed with at least one through-opening for receiving said rigid frame therein; deflection rollers journaled in said rigid frame; at least one conveyor belt looped about said deflection rollers and having a strand for conveying the paper sheets from a location at a beginning of said sheet-conveying surface to a location beyond said lateral alignment region; holding means fixed to the printing machine; and means for removably fastening said rigid frame together with said deflection rollers and said at least one conveyor belt to said holding means so that a strand of the conveyor belt provided for conveying is in a conveying position.

2. Feeding table assembly according to claim 1, wherein the printing machine has side frames, and including a driven shaft journaled in said side frames, and a drive connection from said driven shaft couplable with one of said deflection rollers.

3. Feeding table assembly according to claim 2, including means for independently coupling said drive connection with said one deflection roller when said rigid frame has been fastened to said holding means by said fastening means, and means for independently decoupling said drive connection from said deflection roller when said rigid frame is removed from said holding means.

4. Feeding table assembly according to claim 3, wherein said drive connection includes a gear wheel meshable with a gear wheel connected to said one deflection roller.

5. Feeding table assembly according to claim 1, wherein said conveying strand of said conveyor belt is one of an upper and a lower strand thereof; said conveyor belt being formed with a plurality of uniformly distributed through-openings; and including at least one suction box secured in said rigid frame between said upper and said lower strands of said conveyor belt; said suction box being formed with through-openings extending in a direction towards said conveying strand.

6. Feeding table assembly according to claim 5, wherein the printing machine has a suction-air source affixed thereto; and including a suction-air connection couplable with said suction-air source.

7. A feeding table assembly according to claim 6, wherein said suction-air connection comprises a sealing suction-air coupling coupled with said suction-air source when said rigid frame is disposed on said holding means and decoupled from said suction-air source when said rigid frame is removed from said holding means.

8. Feeding table assembly according to claim 7, wherein said suction-air connection has an opening formed in said rigid frame and a corresponding opening formed on said holding means, said openings being disposed in mutually parallel planes and at least approximately parallel to a direction of movement of said rigid frame upon its introduction into a working position thereof.

9. Feeding table assembly according to claim 7, wherein said suction-air connection has an opening formed in said rigid frame and a corresponding opening formed on said holding means, said openings being disposed in mutually parallel planes and at least approximately perpendicularly to a direction of movement of said rigid frame upon its introduction into a working position thereof.

10. Feeding table assembly according to claim 7, wherein said suction-air connection is fixed to said rigid frame and extends from said suction box to the inside of the strand other than said conveying strand; and a corresponding suc-tion-air connection fixed to the printing machine and extending to the outside of said strand other than said conveying strand.

11. Feeding table assembly according to claim 1, wherein said conveyor belt is a prefabricated elastic belt formed into a closed loop.

12. Feeding table assembly according to claim 11, wherein said belt is formed of continuously knitted fabric.

13. Method of assembling a looped suction conveyor belt with a feeding table in a sheet feeder of a printing machine, which comprises, outside of a working position of a suction conveyor belt; in a feeding table of a sheet feeder of a printing machine, initially assembling the suction conveyor belt on a suction-box module having deflection rollers supported therein, then placing the suction-box module, together with the suction belt assembled thereon, into the working position provided therefore in the feeding table of the printing machine, and fastening the suction-box module in the working position.

14. Method according to claim 13, wherein assembling the suction conveyor belt comprises stretching a finished closed loop of an elastic suction belt about the deflection rollers of the section-box module.

15. Feeding table assembly of a sheet-fed printing machine with conveyor belts for conveying paper sheets from a feed pile, via a region for lateral alignment of the sheets, to downline printing units, comprising:

a module consisting essentially of a rigid frame; means having a sheet-conveying surface extending in a conveying direction over the lateral alignment region and formed with at least one through-opening for receiving said rigid frame therein; deflection rollers journaled in said rigid frame; and at least one conveyor belt looped about said deflection rollers and having a strand for conveying the paper sheets from a location at a beginning of said sheet-conveying surface to a location beyond said lateral alignment region;

holding means fixed to the printing machine; and means for removably fastening said module to said holding means so that a strand of said conveyor belt provided for conveying is in a conveying direction.

* * * * *

UNITED STATES PATENT AND TRADEMARK OFFICE

CERTIFICATE OF CORRECTION

PATENT NO. : 5,423,255
DATED : June 13, 1995
INVENTOR(S) : Burkhard Maass

It is certified that error appears in the above-indentified patent and that said Letters Patent is hereby corrected as shown below:

On the title page, item (73)

"heidelberger Druckmaschinen AG,
Munich, Germany"

should read

-- Heidelberger Druckmaschinen AG,
Heidelberg, Germany-.

Signed and Sealed this

Twelfth Day of September, 1995

*Attest:*

Bruce Lehman

BRUCE LEHMAN

*Attesting Officer*

*Commissioner of Patents and Trademarks*